US010640262B2

(12) United States Patent
Branson

(10) Patent No.: US 10,640,262 B2
(45) Date of Patent: May 5, 2020

(54) RECLOSABLE AIRTIGHT CONTAINER AND METHOD OF MANUFACTURE

(71) Applicant: Global Packaging Solutions Limited, Kowloon Bay (HK)

(72) Inventor: Mark E. Branson, Greenfield, IN (US)

(73) Assignee: Global Packaging Solutions Limited, Kowloon Bay, Kowloon (HK)

( * ) Notice: Subject to any disclaimer, the term of this patent is extended or adjusted under 35 U.S.C. 154(b) by 0 days.

(21) Appl. No.: 15/248,307

(22) Filed: Aug. 26, 2016

(65) Prior Publication Data

US 2018/0057220 A1 Mar. 1, 2018

(51) Int. Cl.
*B65D 33/25* (2006.01)
*B65H 45/00* (2006.01)

(52) U.S. Cl.
CPC ..... *B65D 33/2591* (2013.01); *B65H 45/00* (2013.01)

(58) Field of Classification Search
CPC ..... B65D 33/25; B65D 33/2508; B65D 33/2516; B65D 33/2525; B65D 33/2533;
(Continued)

(56) References Cited

U.S. PATENT DOCUMENTS 6,409,384 B1 * 6/2002 Provan ..... B65D 33/2591 24/429
2003/0235351 A1 * 12/2003 Plourde ..... B65D 33/2591 383/61.2

* cited by examiner

*Primary Examiner* — Jes F Pascua
*Assistant Examiner* — Nina K Attel
(74) *Attorney, Agent, or Firm* — Woodard, Emhardt, Henry, Reeves & Wagner, LLP

(57) ABSTRACT

The present invention includes a reclosable bag having first and second walls and an open top defined by first and second elongate flexible fastener strips attached to the first and second walls, respectively, adjacent the top of the walls. One of the fastener strips has a profile portion forming at least one groove and the other fastener strip has a profile portion forming at least one rib with a portion of each rib received and retained in one of said grooves when the bag top is closed. Each of the fastener strips has a base connected to the respective wall, and each of the strips has an upper edge adjacent the upper edge of the other strip. Third and fourth fastener strips are located within the bag walls parallel to and below the first and second fastener strips. The third and fourth fattener strips have one or more pairs of ribs and grooves. An inverted slider is mounted on the second and third fastener strips within the bag and is movable in one direction longitudinally of the third and fourth fastener strips to progressively separate the one or more rib from the one or more grooves to open the bag: the slider is also being movable in the opposite direction to progressively return the one or more rib portion to a retained condition in the one or more groove to close the bag. A plow extends from the slider to the exterior of said bag above the top of said bag. The plow has a finger tab extending affixed thereto at the distal end thereof. The plow is constructed and arranged to selectively separate said first and second rib and groove and to move said slider within said bag to separate said third and fourth rib and groove when said plow is moved longitudinally along said fastener strips from a first end of said strips to a second end of said strips. The plow is also constructed and arranged to slide said slider longitudinally along the third and fourth fastener strips from said second end and back to said first end so as to interlock said third and fourth ribs and groves and seal said third and fourth fastener strips within said bag. Alternatively, the Claim 1 first and second fastener strips may be selectively sealed by pressing the outer walls of said bag together proximate said first and
(Continued)

second fastener strips so as to longitudinally interlock said first and second fastener strips together.

5 Claims, 5 Drawing Sheets

(58) Field of Classification Search
CPC ..... B65D 33/2541; B65D 33/255; B65D 33/2558; B65D 33/2566; B65D 33/2575; B65D 33/2583; B65D 33/2591
USPC ..... 383/61.1, 63–65
See application file for complete search history.

RECLOSABLE AIRTIGHT CONTAINER AND METHOD OF MANUFACTURE

BACKGROUND OF THE INVENTION

The present invention relates generally to improvements in flexible fasteners of the type having releasably interlocking rib and groove elements with a slider to interlock or separate the rib and groove elements. The invention relates specifically to slide fasteners formed within the reclosable bag. The slide fasteners have two pairs of fastener strips running near the top of the bag and sealed to or integrally formed in the bag wall. Two of the fastener strips has an arrowhead shaped profile extending perpendicularly from and transverse to the top of the bag. The other oppositely opposed fastener strips has a C-shaped profile sized, constructed and arranged for the arrowhead shaped profiles.

A problem in the manufacture of slide fasteners for profile strips is to secure the slider to the profile strip, and to allow sealing of the fastener strip in an essentially leak-proof manner and to prevent removal of the sliders from the bag.

Accordingly, it is the object of the present invention to manufacture slide fasteners in which the fasteners are easily opened, but are substantially leakproof and airtight when sealed.

It is an additional object of the invention to provide sliders or slide fasteners which are extremely difficult to remove from the bag, in order to provide a child safety feature.

It is a further object of the invention to provide slide fasteners which are contained within the bag, with a plow extending out of the top of the bag and a tab for advancing or retracting the slider.

SUMMARY OF THE INVENTION

In light of the above, the present invention provides fastener strips and sliders for use in reclosable containers that substantially overcome the limitation of prior art devices. In one aspect of the present invention, a pair of fastener strips comprise a sealing member having a plurality of sealing portions configured to engage complementary sealing portions of a complementary fastener strip. At least one sealing portion, preferably a lowermost sealing portion, of the fastener strip's sealing member comprises at least one finger member extending therefrom substantially along the entire length of the fastener strip. The at least one finger member, by engaging a complementary sealing portion of the complementary fastener strip, provides an additional degree of sealing, particularly when the fastener strips are in a partially engaged condition. In another aspect of the present invention, a slider comprises an elongate body having top and side walls. Inwardly facing flanges or rails are disposed on, preferably at lower ends of, the side walls. The slider is inverted within the reclosable container The present invention includes a reclosable bag having first and second walls and an open top defined by first and second elongate flexible fastener strips attached to the first and second walls, respectively, adjacent the top of the walls. One of the fastener strips has a profile portion forming at least one groove and the other fastener strip has a profile portion forming at least one rib with a portion of each rib received and retained in one of said grooves when the bag top is closed. Each of the fastener strips has a base connected to the respective wall, and each of the strips has an upper edge adjacent the upper edge of the other strip. Third and fourth fastener strips are located within the bag walls parallel to and below the first and second fastener strips. The third and fourth fattener strips have one or more pairs of ribs and grooves. An inverted slider is mounted on the second and third fastener strips within the bag and is movable in one direction longitudinally of the third and fourth fastener strips to progressively separate the one or more rib from the one or more grooves to open the bag: the slider is also being movable in the opposite direction to progressively return the one or more rib portion to a retained condition in the one or more groove to close the bag. A plow extends from the slider to the exterior of said bag above the top of said bag. The plow has a finger tab extending affixed thereto at the distal end thereof. The plow is constructed and arranged to selectively separate said first and second rib and groove and to move said slider within said bag to separate said third and fourth rib and groove when said plow is moved longitudinally along said fastener strips from a first end of said strips to a second end of said strips. The plow is constructed and arranged to slide said slider longitudinally along the third and fourth fastener strips from said second end and back to said first end so as to interlock said third and fourth ribs and groves and seal said third and fourth fastener strips within said bag.

The inwardly facing flanges are configured substantially directly opposite each other and possess dimensions such that they define a gap between outermost surfaces of the inwardly facing flanges. The gap defined by the inwardly facing flanges has dimensions such that the sealing members of the opposing fastener strips, and particularly the sealing portion having the at least one finger member and its complementary sealing portion, are urged together to provide an additional degree of sealing, yet not completely interlocking, engagement. Preferably, the gap has dimensions that are at least less than a combined width of the fastener strips when they are in a partially engaged condition. Fastener strips and/or sliders in accordance with the present invention may be beneficially incorporated into reclosable containers, particularly reclosable bags.

DETAILED DESCRIPTION OF THE PREFERRED EMBODIMENT

The foregoing description and drawings merely explain and illustrate the invention and the invention is not limited thereto, except in so far as those who have the disclosures before them are able to make modifications and variations therein without departing from the scope of the invention.

Figure 1:
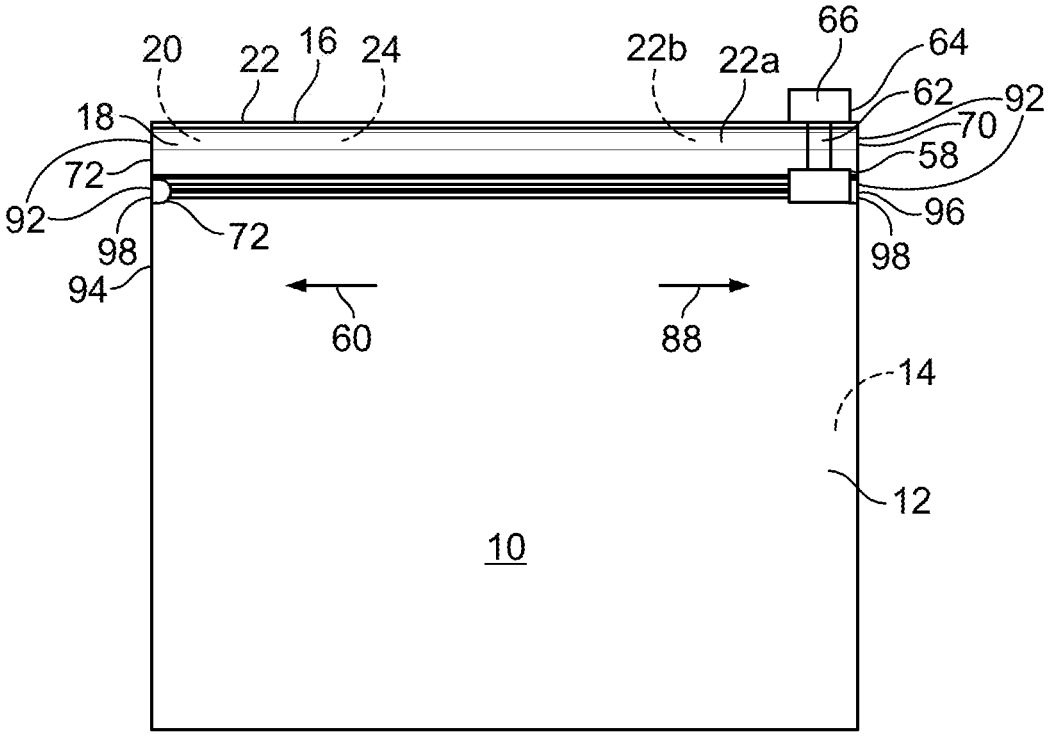
FIG. 1 of the drawings is a front elevation view of a reclosable container of the present invention showing in particular a zipper seal, extended plow, an inverted slider within the container and a finger grip of the slider outside of the container.
Figure 2:
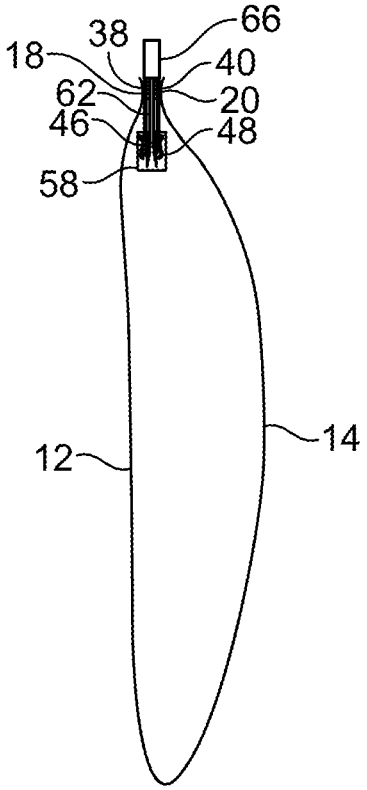
FIG. 2 of the drawings is a side cutaway view of the reclosable container of FIG. 1.
Figure 3:
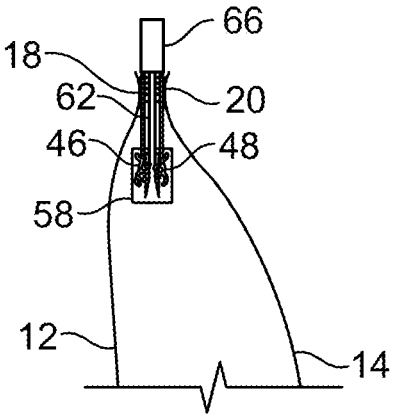
FIG. 3 of the drawings is a partial side cutaway view of the reclosable container of FIGS. 1 and 2.
Figure 4:
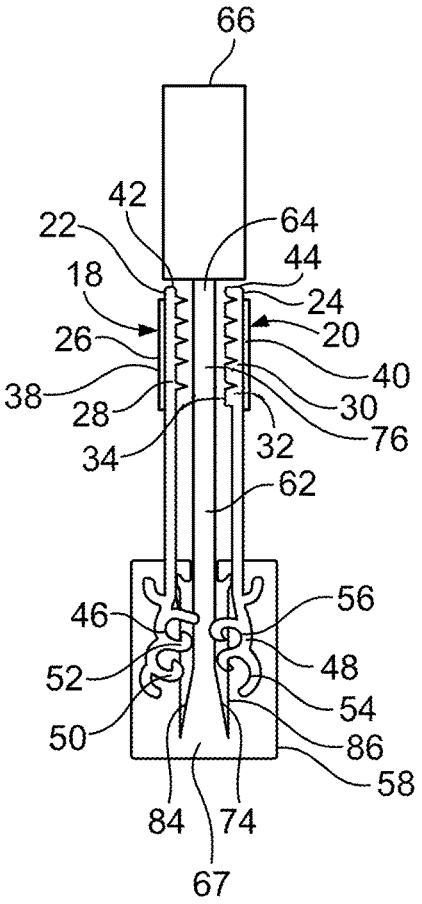
FIG. 4 of the drawings is a vertical section of the reclosable fastener of FIGS. 1, 2 and 3, showing in particular an inverted slider closing third and fourth reclosable fasteners, a plow, a grip at the top of the plow, and first and second fasteners located approximate the plow and grip.

As shown in FIG. 1 of the drawings, a reclosable bag 10 having first and second walls 12 and 14 and an open top 16 is defined by first and second elongate flexible strips 18 and 20 attached to the first and second walls 12 and 14 respectively adjacent to the tops 22 and 24 of the walls 12 and 14. As best seen in FIGS. 2 and 4, one of the fastener strips 18 has a profile portion 26 forming at least one groove 28. The other fastener strip 20 has a profile portion 30 forming a rib 32 with a portion of the rib 34 received and retained within the groove 28 when the bag 10 is closed. Each of the strips 18 and 20 has a base 38 and 40 respectively connected to the respective walls 12 and 14, and each of the strips 18 and 20 further has an upper edge 42 and 44 adjacent to the upper edge of the other strip 18 and 20 respectively. As further stated FIG. 1 third and fourth fastener strips 46 and 48, respectively, are located within the bag walls 12 and 14 parallel to and below the first and second fastener strips 18 and 20. The third and fourth strips 46 and 48 have one or more pairs of ribs and grooves 50, 52, 54 and 56 which selectively interlock with each other as required. Rib 50 interlocks with groove 54 and rib 52 interlocks with groove 56. An inverted slider 58 is mounted on the third and fourth fastener strips 46 and 48 within the bag 10, to prevent product from becoming trapped in the fastener strips 46 and 48. Inverted slider 58 is moveable in one direction 60 (FIG. 1) longitudinally across the bag 10 to progressively separate the one or more ribs 50 and 52 from the grooves 54 and 56 to open the bag. The inverted slider 58 is conversely moveable in the opposite direction 61 to progressively return the one or more rib portions of 50 and 52 to a retained condition in one or more of the grooves 54 and 56, in order to close the bag 10.

As further seen and in FIGS. 1, 2, 4 and 6, a plow 62 extends from slider 58 to the exterior 64 of bag 10 above the tops 22 and 24 of the bag walls 12 and 14. Plow 62 has a finger tab 66 affixed thereto and extending vertically therefrom at the distal end 67 of the slider 58. Plow 62 is constructed and arranged so that moving it longitudinally in first direction 60 selectively separates first rib 32 from first groove 28. Simultaneously, when plow 62 is moved in first direction 60 it also moves slider 58 within bag 10 to separate third and fourth fastener strips 46 and 48, namely, ribs 50 and 52 from grooves 54 and 56, from a first end 70 (FIG. 1) of fastener strips 46 and 48 to a second end 72 of said strips 46 and 48. In a preferred embodiment, plow 62 is formed integrally with slider 58 and is made of one homogenous unit of plastic. However, plow 62 and slider 60 may be formed separately and affixed to each other by means of ultrasonic sealing, adhesive or other commonly known methods of manufacture.

First and second fastener strips 18 and 20 may also be selectively sealed together by pressing the outer walls 12 and 14 of bag 10 together proximate first and second fastener strips 18 and 20 and manually interlocking said first and second fastener strips 18 and 20 together longitudinally by sliding the user's fingers along the outer walls 12 and 14 proximate the fastener strips 18 and 20, namely, on the outside of the bag walls 22*a* and 22*b*.

Figure 5:
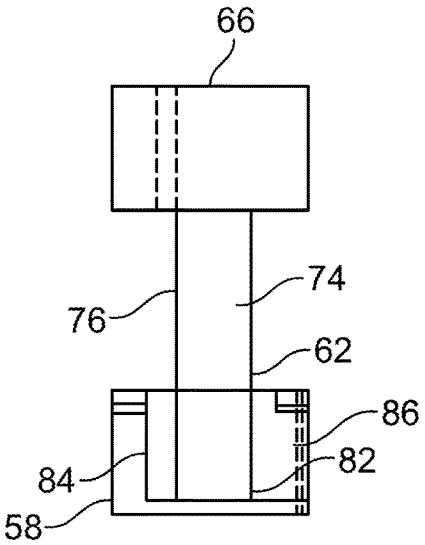
FIG. 5 is a side view of the slider, plow and grip of FIGS. 1-4.

As best in FIGS. 4 and 5, separator 74 has a first side 76 which is sized, constructed and arranged for entering between the edges 78 and 80 of fastener strips of 18 and 20 as well as fastener strips 46 and 48. When separator 74 is moved it pivots the ribs of 50 and 52 so as to separate the ribs from grooves 54 and 56, and slider 58 is moved in the first direction 60, thereby wedging the fastener strips 15 and 20, and 46 and 48 apart. Similarly, separator 74 has a second side 82 and the slider has interior walls 84 and 86 when slider 58 is moved in the opposite direction 88, (FIG. 1), so that the interior walls 84 and 86 squeeze the fastener strips 12 and 14, and 46 and 48 together so that they merge.

Figure 6A:
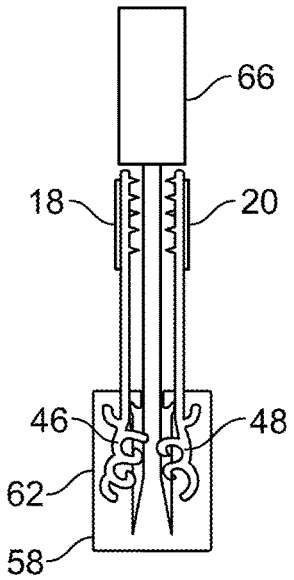
FIG. 6*a* of the drawings is a partial cutaway view of the reclosable fasteners of FIGS. 4 and 5 showing in particular the slider enclosed around the fastener on the inside of the bag.
Figure 6B:
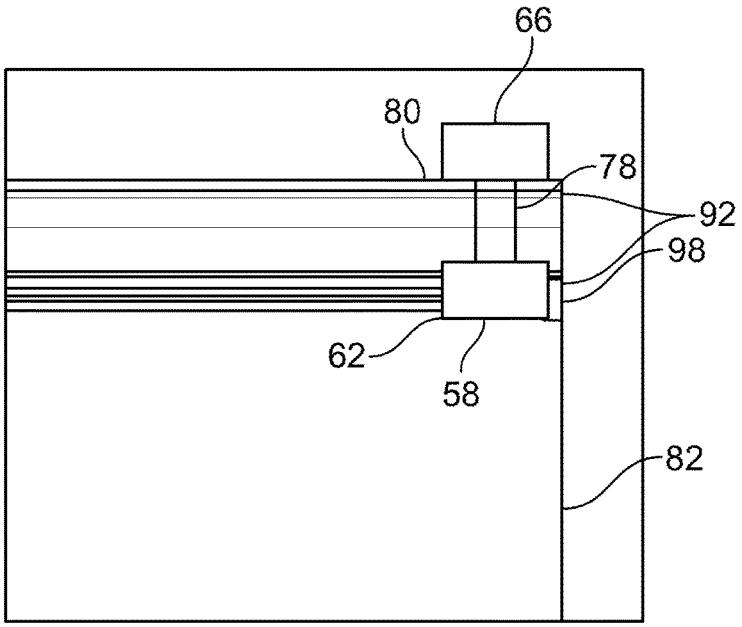
FIG. 6*b* is a front perspective view, partially broken away, showing the slider body, the slider plow, a spot seal at the end of the fastener strip, a seal of the first and second fastener strips at the edge of the reclosable container, a flange along the edge of the reclosable container, and a slider grip at the top of the plow.

As best seen in FIGS. 1 and 6*b* the proximal and distal ends 90 and 92 of each of the fastener strips, 18, 20, 46 and 48 are ultrasonically sealed to each other at spot seal 98 and to bag walls 12 and 14 proximate to lateral edges 94 and 96 of bag 10.

Figure 9:
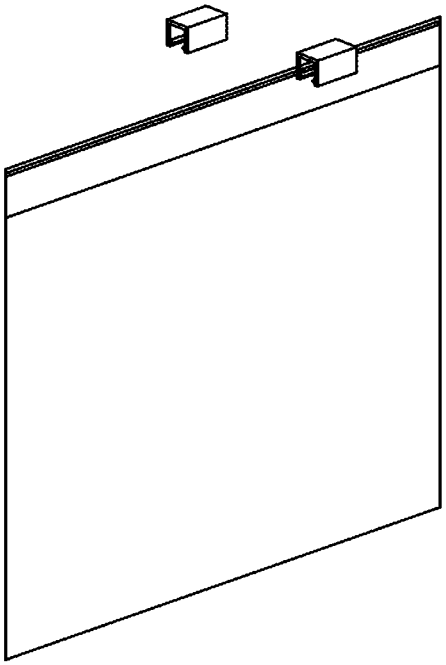
FIG. 9 of the drawings is a perspective view, assembly of the slider to the bag in FIG. 7.
Figure 10:
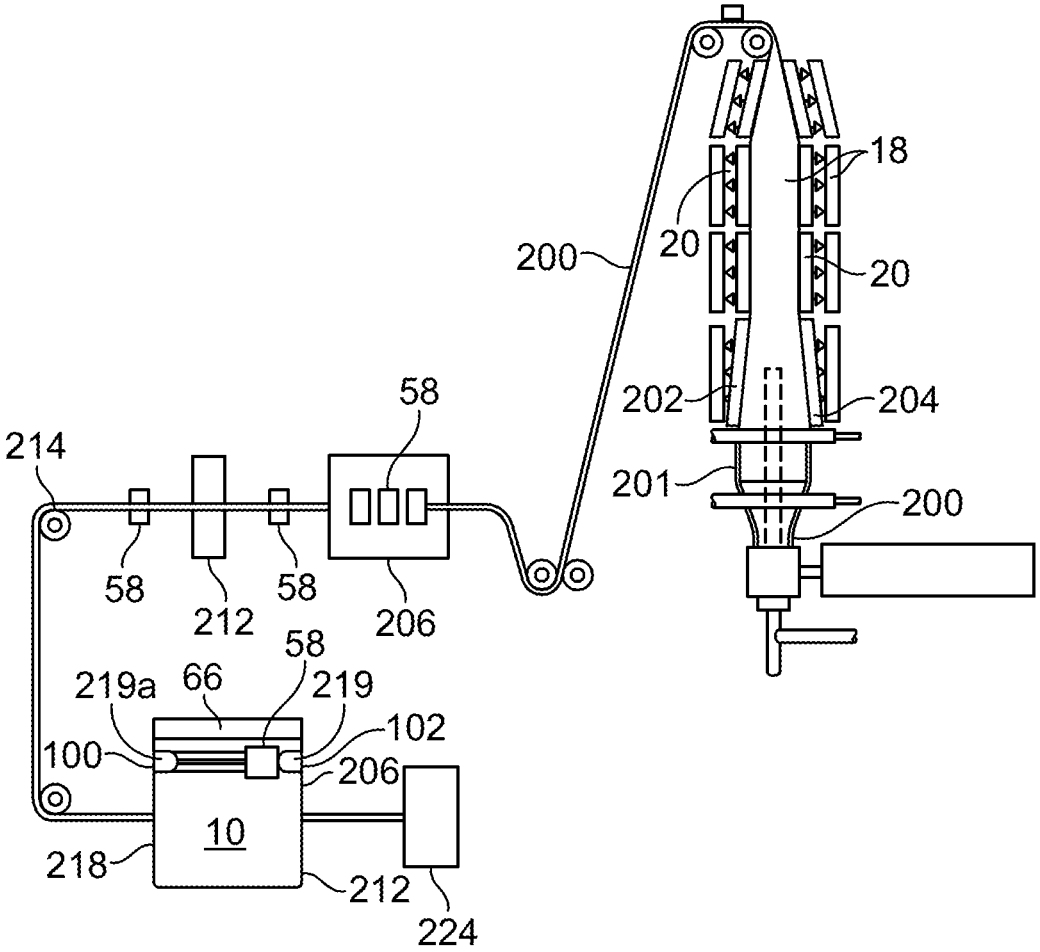
FIG. 10 of the drawings is a front view of the apparatus for extruding thermoplastic film having fastener profiles integrally formed therein.

As seen in FIG. 9 of the drawings the present invention further includes a method of manufacture of reclosable bags. As seen in FIG. 10, the length of thermoplastic film 200 is extruded as a tube 201. Tube 201 is slit so as to form opposed longitudinal edges 202 and 204. Simultaneously, a pair of fastener strips 18 and 20 are extruded on longitudinal edges 202 and 204, respectively, or the fastener strips can be formed separately in a separate operation. Similarly, fastener strips 46 and 48 are also extrudes onto bag walls 12 and 14. Film 200 is preferably a low density polyethylene such as Exxon 316 having a thickness of 4 mm. Film 200 may also be laminated to other materials such as foil, nylon, or other commonly known laminating materials.

Film 200 and fastener strips 18 and 20 are cooled. Sliders, such as slider 58, may be applied at spaced intervals to fastener strips 18 and 20 by slider dispenser 206. The slider has first and second travel-end stop positions on the strips, the first stop position being the bag-closed stop position, and the second being the bag-opened stop position.

Figure 7:
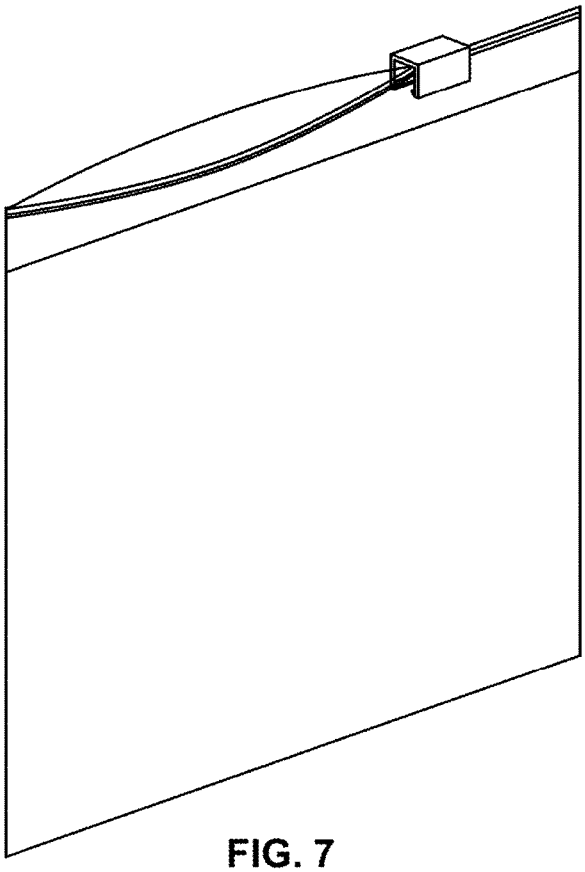
FIG. 7 of the drawings is a standard slider bag known in the prior art.
Figure 8:
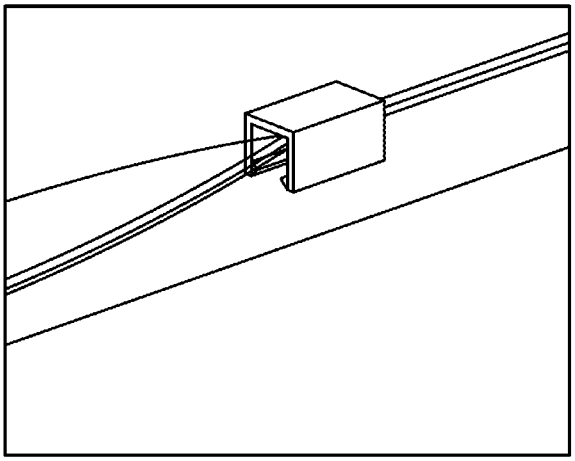
FIG. 8 is a partial perspective view of the slider bag of FIG. 6*b*.

Each of the fastener strips has either a male or female profile for interlocking with the other. Once the sliders attach to the fastener strips, the film 200 is cross-sealed at location 212 to form the first side 206 of a bag 10. A second cross-seal 214 is sealed on a bag tube 200 to form a second side 218 of bag 10, so as to capture a single slider 58 between the first and second sides 206 and 218 of bag 10. A spot seal 219 and 219*a* such as those found by an ultrasonic sealing may be used to seal the ends 100 and 102 of the fastener strips 18 and 20 on each bag 14 (FIG. 7).

Bag 10 is then cut from the film tube 216 by means of a hot wire or knife 224. A finished bag 10 is thus provided with a reclosable fastener 230 and a slider 58 for opening and closing the bag 210.

Figure 11:
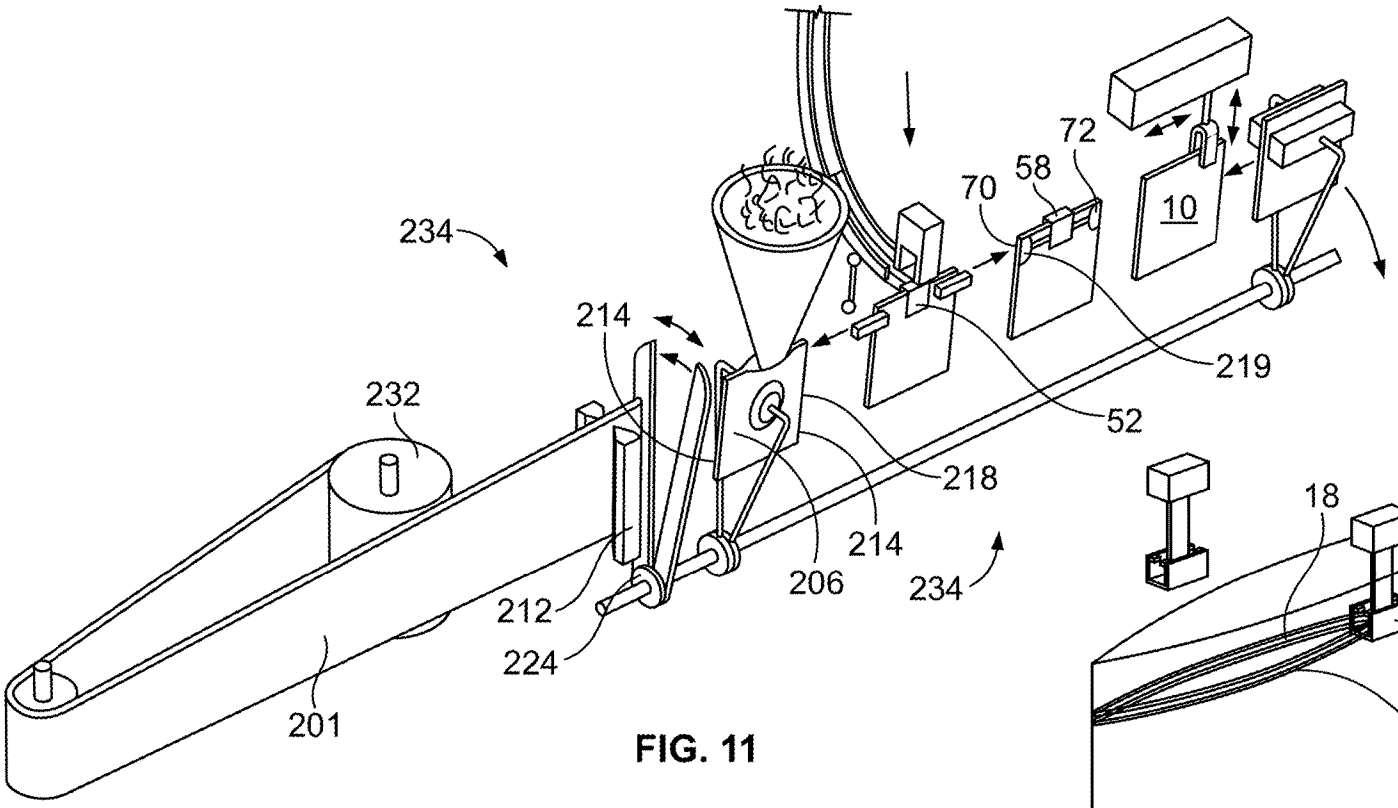
FIG. 11 of the drawings is a schematic diagram showing converting of the plastic film manufactured in FIG. 10 into reclosable bags utilizing a conventional bag making machine having a slider application device thereon.

Alternatively, as seen in FIG. 11, tube 201 may be cooled and then wound onto a roll 232. Roll 232 may then be shipped to the user who has a bag making machine 234. Roll 232 may then be intermittently unwound from roll 232. Bag 10 is then cut from the film tube 201 by means of a hot wire or knife 224. Cross seals 212 are formed across bag tube 216. A second cross-seal 214 is sealed on a bag tube 216 to form a second side 218 of bag 10. Sliders 58 are then applied after filing of product at spaced intervals a single slider 58 is applied between the first and second sides 206 and 218 of bag 10. A spot seal 219 such as those found by an ultrasonic sealing may be used to seal the ends 70 and 72 of the fastener strips 18 and 20 on each bag 10.

A finished bag 10 is thus provided with a reclosable fastener 230 and a slider 58 for opening and closing the bag 10.

Figure 12:
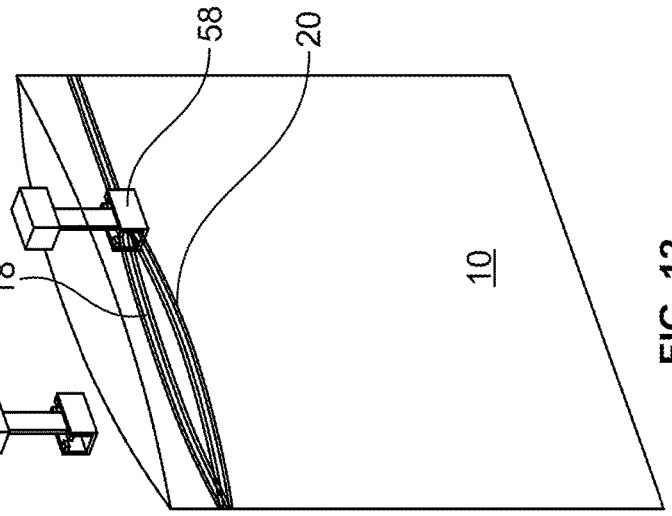
FIG. 12 of the drawing is a front perspective view partially broken away of the inverted slider being assembled onto the fastener strips inside of the bag.

As best seen in FIG. 12, slider 58 passes through fastener strips 18 and 20 when they are separated, then snaps onto them from below.

The invention claimed is:

1. A reclosable bag comprising:

first and second walls;

an open top defined by first and second elongate flexible fastener strips attached to the first and second walls, respectively, adjacent a top of the first and second walls, wherein one of said first and second fastener strips includes a profile portion forming at least one groove and the other of said first and second fastener strips includes a profile portion forming at least one rib, wherein a portion of each at least one rib is configured to be received and retained in one of said at least one grooves in a first retained condition to form a first seal when the open top is closed, wherein each of the first and second fastener strips includes a base connected to the respective wall, and wherein the first fastener strip includes an upper edge adjacent to an upper edge of the second fastener strip;

third and fourth fastener strips located within the first and second walls parallel to and below and spaced from the first and second fastener strips, said third and fourth fastener strips having one or more pairs of ribs and grooves that may be connected in a second retained condition to form a second seal;

an inverted slider mounted on the third and fourth fastener strips within the bag and movable in a first direction longitudinally of the third and fourth fastener strips to progressively separate the one or more pairs of ribs from the one or more pairs of grooves to open the bag, and the slider being movable in an opposite second direction to progressively return the one or more pairs of ribs to the second retained condition in the one or more pairs of grooves to close the bag;

wherein the slider comprises of inwardly facing flanges separated by a predetermined distance at least less than a combined width of the third and fourth fastener strips when partially engaged such that the third and fourth fastener strips are easily opened but substantially leak-proof when sealed, further comprising, a plow extending from the slider to the exterior of the bag and above the top of the first and second walls;

the slider being located below the top of the first and second walls and engaging the third and fourth fastener strips so that the slider is entirely enclosed within the bag and below the first seal when the first and second fastener strips are in the first retained condition, the plow further having a finger tab affixed thereto and extending therefrom at a distal end thereof;

wherein the finger tab is located above the top of the first and second walls and does not engage any of the first and second fastener strips or the third and fourth fastener strips; and wherein the plow is constructed and arranged to selectively separate the at least one rib and the at least one groove of the first and second fastener strips when moved longitudinally in the first direction and simultaneously to move the slider within the bag to separate the one or more pairs of ribs from the one or more pairs of grooves of the third and fourth fastener strips when moved longitudinally in the first direction.

2. The bag of claim 1, wherein the plow is integral with the slider and is made of one integral homogenous unit of plastic.

3. The bag of claim 2, wherein said plow is constructed and arranged to slide said slider longitudinally along said third and fourth fastener strips in the opposite second direction so as to interlock said one or more pairs of ribs and the one or more pairs of grooves of the third and fourth fastener strips and return the one or more pairs of ribs and grooves to the second retained condition.

4. The bag of claim 1, wherein said first and second fastener strips may be selectively sealed in the first retained condition forming the first seal by manually pressing the first and second walls of said bag together proximate said first and second fastener strips and manually interlocking said first and second fastener strips together longitudinally.

5. The bag of claim 1, wherein said slider has first and second travel-end stop positions on said third and fourth fastener strips, the first travel-end stop position being a bag-closed stop position, and the second travel-end stop position being a bag-opened stop position.

* * * * *